US007475877B2

(12) United States Patent
Mier

(10) Patent No.: US 7,475,877 B2
(45) Date of Patent: Jan. 13, 2009

(54) APPARATUS AND METHOD FOR A RACE GAME WHEREIN COMPETITORS APPLY DEFENSIVE STRATEGIES AND MATH SKILLS TO WIN

(76) Inventor: Kelly J. Mier, 596 Smithridge Park, Reno, NV (US) 89502

( * ) Notice: Subject to any disclaimer, the term of this patent is extended or adjusted under 35 U.S.C. 154(b) by 261 days.

(21) Appl. No.: 11/507,849

(22) Filed: Aug. 22, 2006

(65) Prior Publication Data

US 2007/0257433 A1 Nov. 8, 2007

Related U.S. Application Data

(60) Provisional application No. 60/798,129, filed on May 5, 2006.

(51) Int. Cl.
*A63F 3/00* (2006.01)

(52) U.S. Cl. ..... 273/249; 273/236; 273/287

(58) Field of Classification Search ..... 273/236, 273/249, 255, 287

See application file for complete search history.

*Primary Examiner*—Vishu K Mendiratta
(74) *Attorney, Agent, or Firm*—Raymond M. Galasso; Galasso & Associates, LP

(57) ABSTRACT

A race type board game in which two or more players compete by rolling dice to win turns and advance along a game track comprising a linked set of player squares or spaces. Players advance according to a number displayed on a drawn advancement card where the card can be drawn when a player wins a turn. Players may impede the progress of opposing players by purchasing and placing defensive traps on various squares along the game track. Trapped players extricate themselves from the traps using a combination of chance, quick thinking and math skills.

4 Claims, 5 Drawing Sheets

APPARATUS AND METHOD FOR A RACE GAME WHEREIN COMPETITORS APPLY DEFENSIVE STRATEGIES AND MATH SKILLS TO WIN

CROSS REFERENCE TO RELATED APPLICATIONS

This application claims priority to U.S. Provisional Patent Application having Ser. No. 60/798,129 filed May 5, 2006 entitled "Torrapu", having a common applicant herewith.

FIELD OF THE DISCLOSURE

The disclosures made herein relate generally to multiplayer board games and, more particularly, to multiplayer board games wherein players move along a game play track consisting of a set of linked squares, wherein the players compete to reach the finish square first and wherein players use a variety of tactics including purchasing and placement of traps and issuance of challenges to impede the progress of competitor players.

BACKGROUND

The inventive disclosures herein are directed to a multiplayer board game, and in particular to multiplayer board games wherein players move along a linked track of squares and apply a variety of defensive strategies and basic mathematics skills to be the first to reach the finish square.

Board games of various types are well known and enjoyed by families over generations. Many varieties of board games are known having a game play track of spaces or squares and a set of player pieces or tokens. The players move along the game track according to numbers affixed to advancement cards drawn a result of winning a turn with a dice roll and according to the rules of the game. Some board games of this variety determine the winner purely on chance, while in others the players have a role in determining their own outcome by the choices and decisions they make during game play.

However, with known board games there exists a need for a game having a new set of challenges and game play dynamics providing captivating game play, a board game which challenges the users to apply defensive skills to impede competitors, a game which employs basic math skills in the game play providing players the opportunity to improve mental math skills and concentration to respond quickly to challenges during game play.

SUMMARY OF THE DISCLOSURE

Accordingly, embodiments of the inventive disclosures made herein comprise various embodiments of a multiplayer board game of the race variety wherein competitors apply defensive strategies including placement of traps and issuance of challenges to win the game.

Disclosed herein is a new board game designed to appeal to consumers looking for an educational and fun new board game to play with family and friends. The board game disclosed herein is intended for play by players from ages ten to adult. To move around the track on the board and win the game players must solve a number of basic math problems as well as use defensive strategies to impede their opponents' advancement on the game while continuing to advance their player token to reach the finish square first and win the game.

As discussed earlier, the disclosed game is of the race type genres in which two or more players compete by rolling dice to win turns and advance around a game track comprising a linked set of player squares. Players advance according to the printed number or alternately the number of dots on picked advancement cards where the card can be drawn when a player wins a turn. Players may impede the progress of opposing players by purchasing and placing defensive traps upon various squares along the game track. Defensive traps consist of colored pegs that are inserted into trap peg receiving holes provided in each square. Players who become trapped on a square having a black trap or a defensive trap matching the color of their piece or player token extricate themselves from the trap using a combination of chance, quick thinking and math skills.

In one or more embodiments the game comprises a game board having a somewhat circular game track applied along outer portions of the game board and proximate to the edge of the board. The game board itself may be rectangular or square in shape, although the inventive disclosures herein are not limited to the shape of the game board. For example, the game board can be circular with the game track formed in a circular fashion on the board. In the depicted preferred embodiment of the game the game board is of the square form discussed above. The game board may comprise heavy cardboard or other game board substrate material, coated with a protective plastic layer or laminate. The game board may also be realized from other materials, for example vinyl, although it is known that it is more difficult to print graphics and text onto vinyl.

Within this specification we use the word 'affixed' to indicate that an item may be printed onto, secured onto, molded onto or otherwise secured onto a substrate material in a permanent way.

The game board comprises a game play track affixed to the board by any practical means. The track has a plurality of player squares linked on to the next by a series of graphical indicia such as arrows so that the direction and path for progress along the track from square to square is clear and apparent to the players of the game. The game play track has a start square on one end and a finish square on an opposing end. As the game has a definite start and end square and is traversed only once during game play, it differs from certain other varieties of game boards wherein the track closes upon itself and the players repeatedly traverse the game track until a winner is declared. The definite start square, finish square and fact that the winner is decided by the first player to reach the finish square puts this game in the race genre. On one embodiment, the track consists of a linked series of forty squares, although the invention is not limited to the use of forty squares on the game play track as any number of squares may be used without deviating from the intention of this inventive disclosure.

The squares forming the track each have a colored center portion consisting of one color selected from the set of unique colors of the game's player tokens such that the game play track is representative of the player token colors. Each square along the track except for the start and finish squares have one or more dots affixed to the square. The game board has a plurality of trap holding squares secured to the board, one trap holding square for each player token. Within a central portion of the board are blank squares to designate positions where cards used in game play are placed, as well as circles affixed to game board within the central portion where white, blue and discarded chips are placed during play.

These and other objects of the invention made herein will become readily apparent upon further review of the following specification and associated drawings.

BRIEF DESCRIPTION OF THE DRAWINGS

The drawings show a form of the invention that is presently preferred; however, the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

Figure 1:
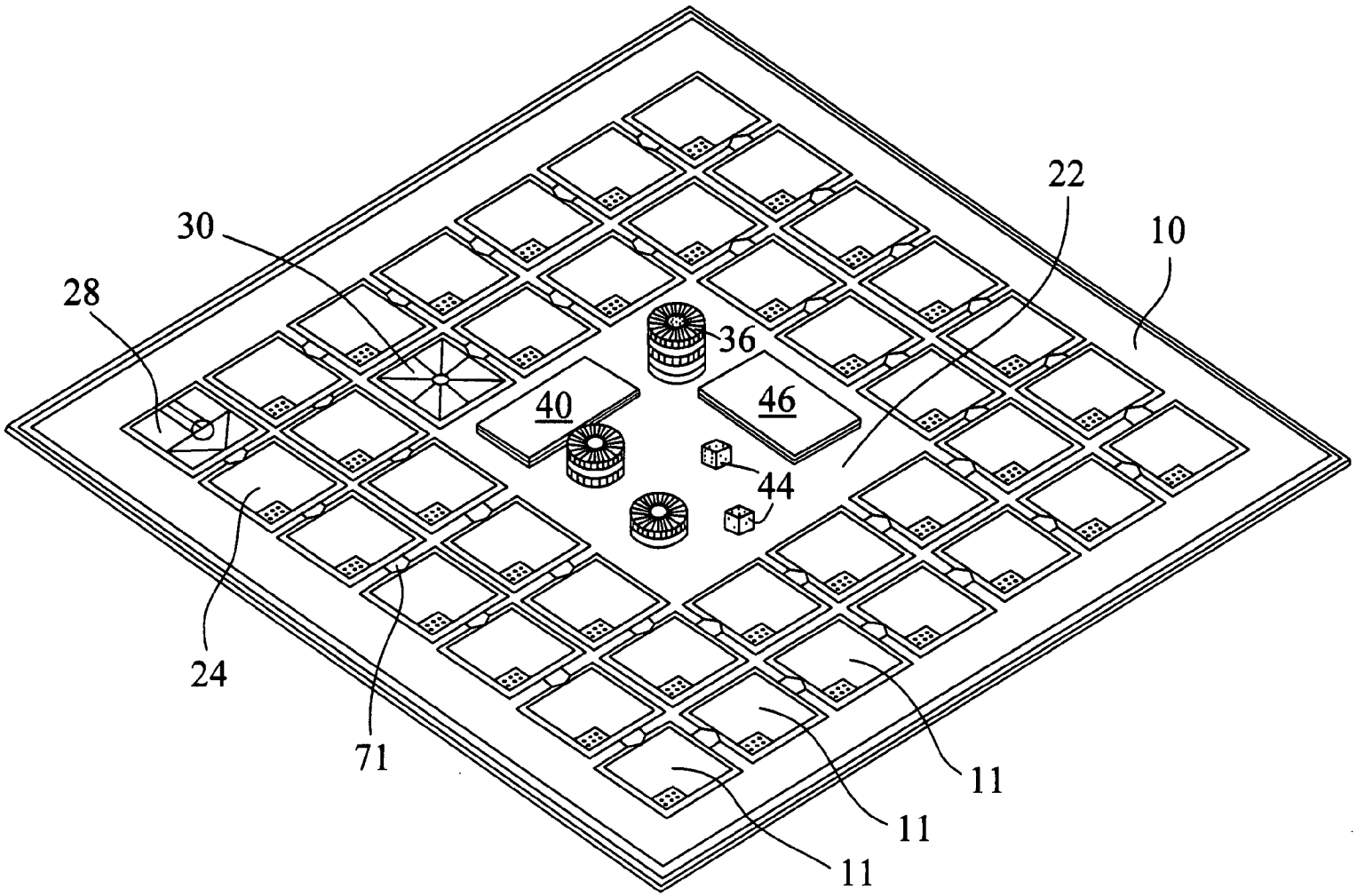
FIG. 1 depicts a top perspective view of one embodiment of the game board together with game track and various game pieces required for play of the race game in accordance with the inventive disclosures herein.
Figure 2:
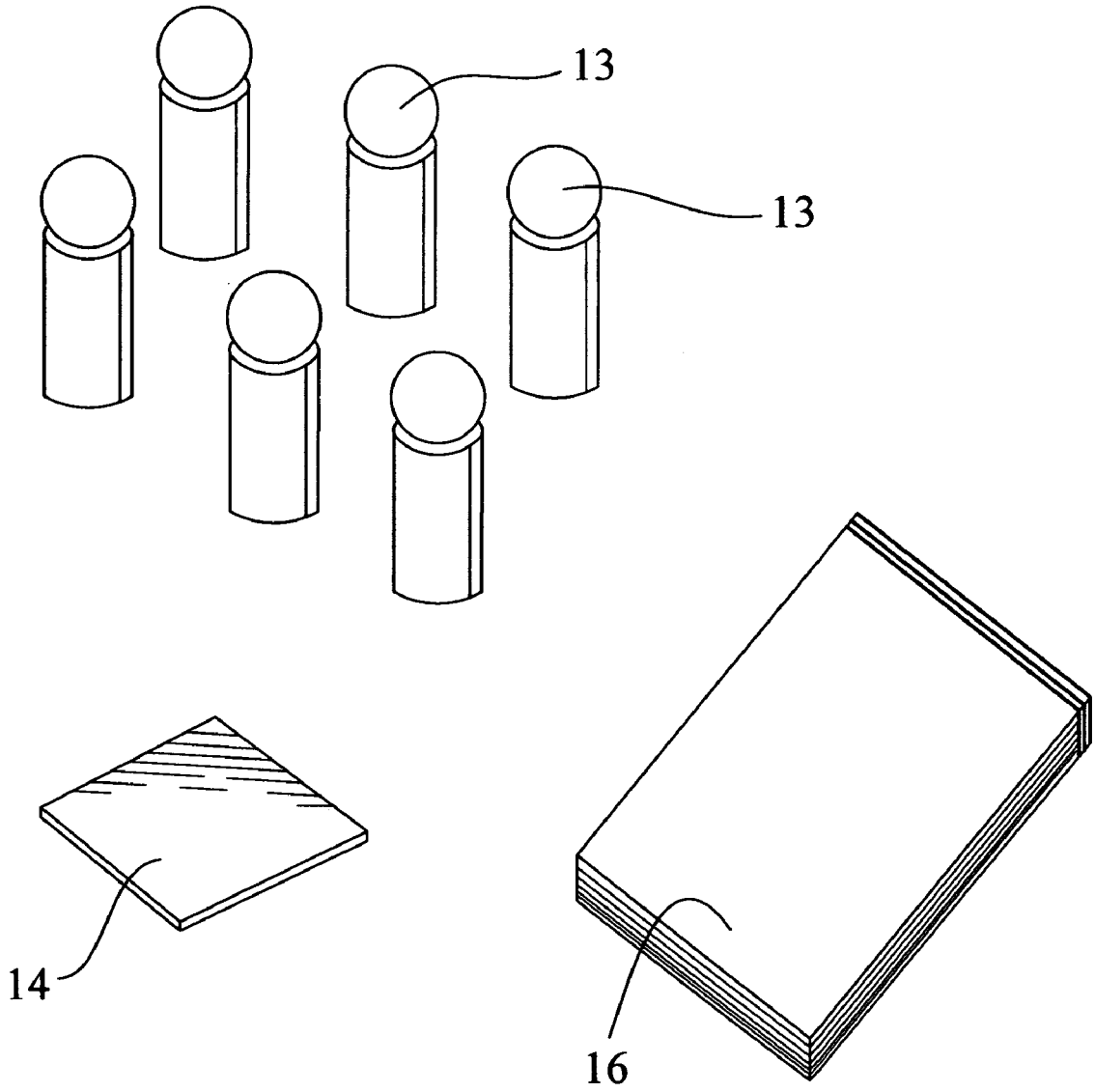
FIG. 2 depicts a perspective view of the player game pieces or game tokens, the player piece platforms, and score pads for one embodiment of the race game in accordance with the inventive disclosures herein.
Figure 3:
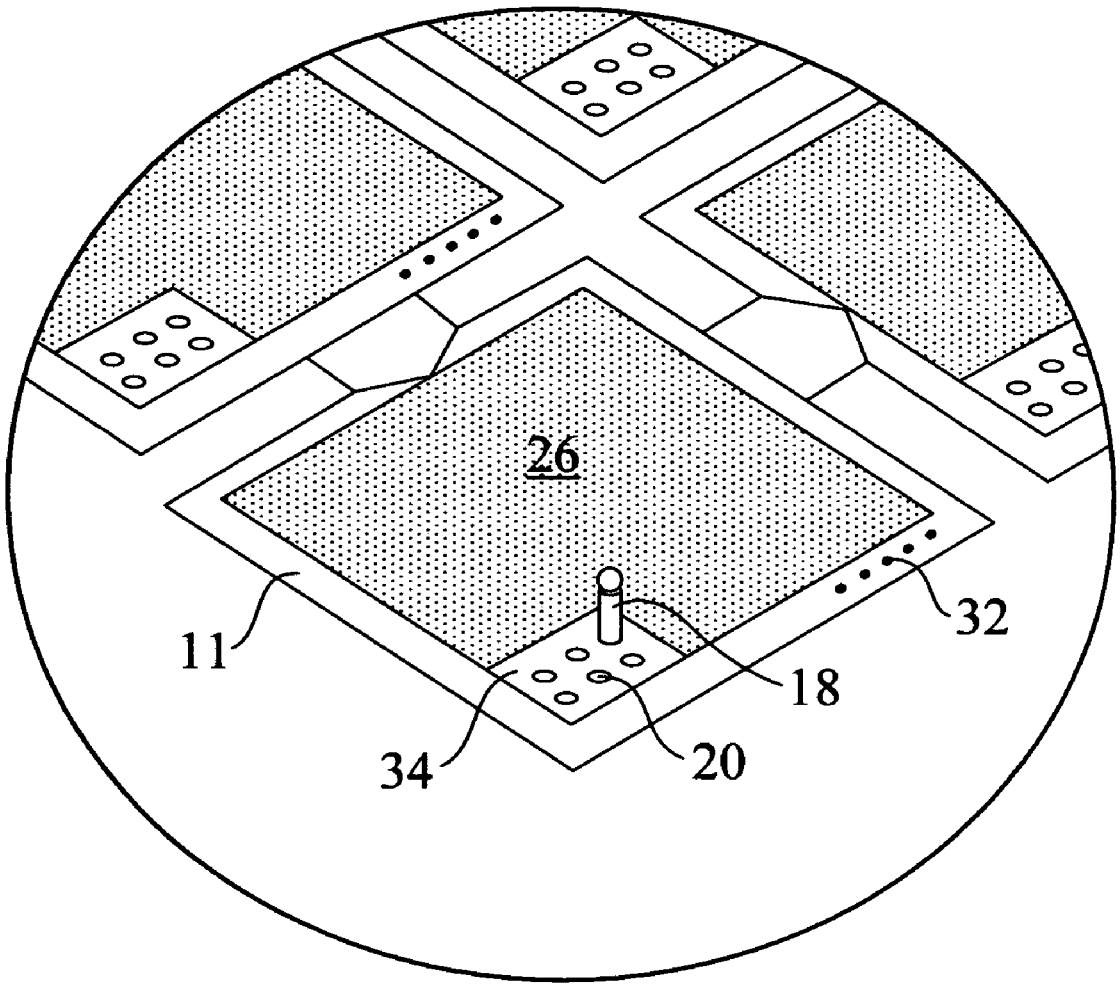
FIG. 3 depicts an enlarged view of a colored square of the game track illustrated on the game board of FIG. 1 illustrating a trap peg inserted onto a hole in the square on the game board in accordance with the inventive disclosures herein.
Figure 4:
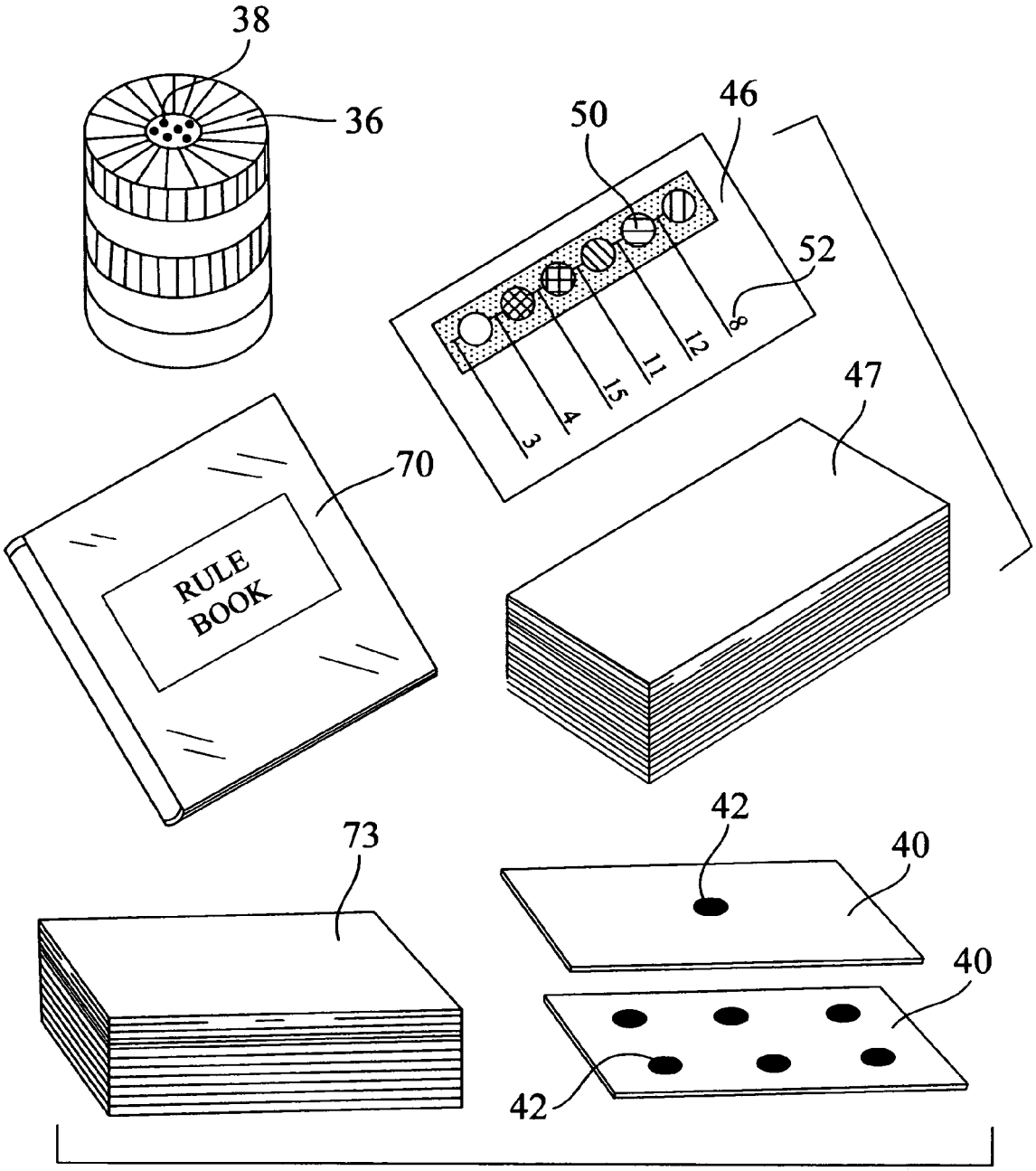
FIG. 4 depicts an exemplary embodiment of a set of white chips having dots affixed thereon delineating the maximum number of rolls a player must perform to get out of a trap, as well as an exemplary embodiment of the advancement cards and color challenge cards. Also depicted thereon is a rule book containing rules of playing the game.
Figure 5:
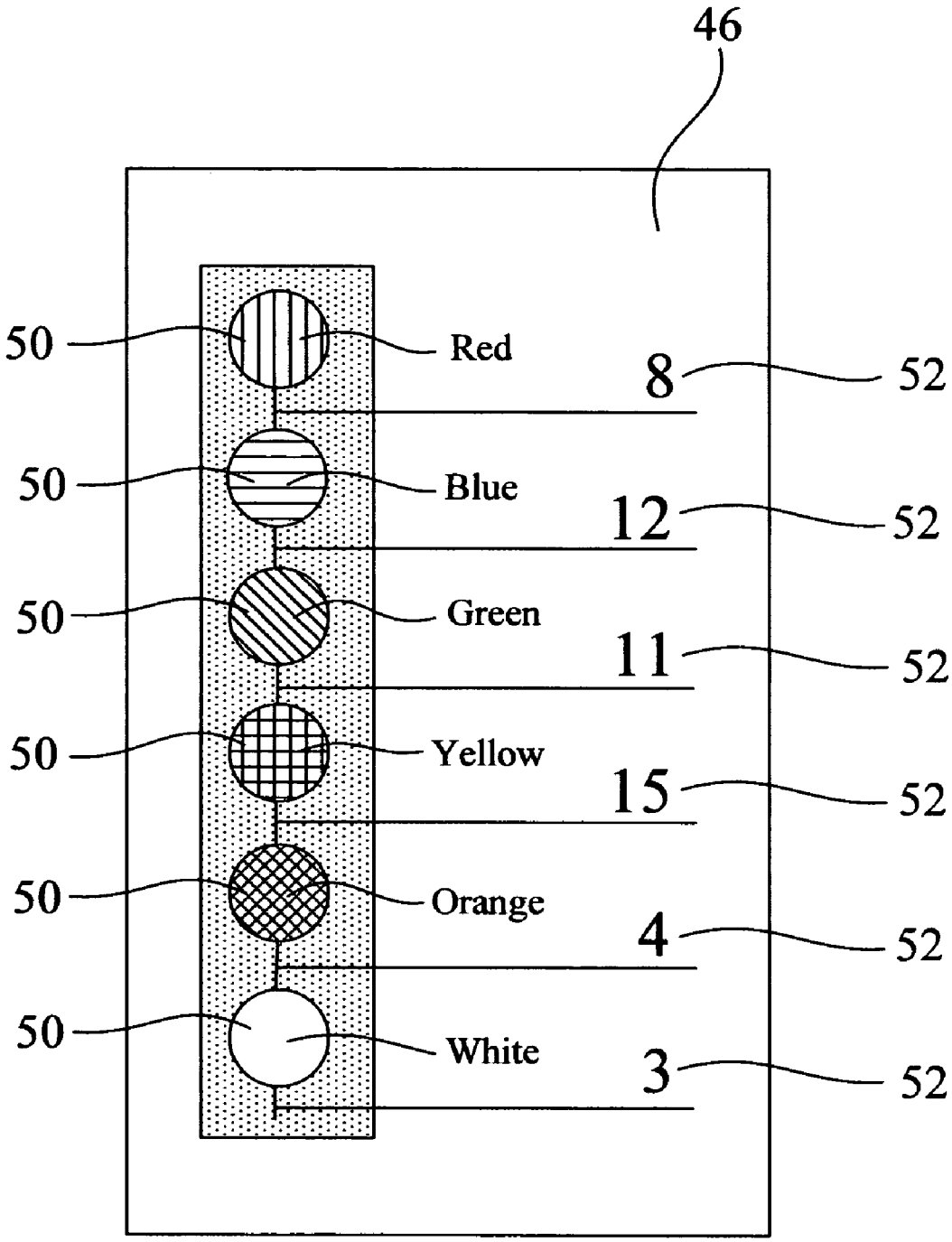
FIG. 5 depicts a close-up view of a color challenge card.

FIG. 1 depicts a top perspective view of one embodiment of the game board 10 together with game track 24 comprising of a plurality of linked player squares 11 and various game pieces required for play of the race game in accordance with the inventive disclosures herein. FIG. 2 depicts a perspective view of the player game pieces or game tokens 13 used to represent player movements on the track, the player piece platforms 14 and score pads 16 for one embodiment of the race game in accordance with the inventive disclosures herein. FIG. 3 depicts an enlarged view of a colored square 11 of the game track illustrated on the game board 10 of FIG. 1 illustrating a trap peg 18 inserted onto a hole in the square 11 on the game board in accordance with the inventive disclosures herein. Each square is provided with a plurality of trap peg receiving holes 20. The central area 22 provides board space for placing the various chips, card decks and the dice during play of the game. FIG. 4 depicts an exemplary embodiment of a set of white chips 36 having dots 38 affixed thereon delineating the maximum number of rolls a player must perform to get out of a trap, as well as an exemplary embodiment of the advancement cards 40 having dots 42 affixed thereon, a rule book 70 for playing the game and color challenge cards 46. FIG. 5 depicts a close-up view of a color challenge card 46.

The game board comprises a game play affixed to the board by any practical means. The track has a plurality of player squares linked on to the next by a series of graphical indicia such as arrows 71 such that the direction and path for progress along the track from square to square is clear and apparent to the players of the game. On one embodiment, the track consists of a linked series of forty squares, although the invention is not limited to the use of forty squares on the game play track. Any number of squares may be used without deviating from the intention of this inventive disclosure. Additional player spaces do not need to be squares as illustrated but may, for example, comprise a linked track of circles, ellipses, and any polygon to achieve a game track for playing the game.

Within this specification play spaces of any shape are referred to as squares with the understanding that in embodiments of the present inventive disclosures the shape of the linked play spaces on the track are not limited to the shape of a square.

The linked squares 11 forming the track 24 each have a colored portion 26 having one color selected from the set of unique colors of the player tokens 13 such that the game play track 24 is representative of the player token colors. Each square along the track except for the start square 28 and finish square 30 have one or more dots 32 affixed to the square. The game board has a plurality of trap holding squares 34 affixed to the board on the interior of each player square 11. Within a central portion 22 of the board 10 are blank rectangles to designate positions where cards used in game play are placed, as well as circles affixed to game board positions where white, blue and discarded chips are placed during play.

The game comprises a plurality of player tokens 13 with each player receiving one unique token. As in typical board games each token 13 represents the movement of a player along a game play track 24. Each token is provided with a unique color for easy identification by the players with the exception that black is not one of the player token colors (having to do with defensive traps in the game, which are discussed below).

The game also comprises a plurality of defensive trap pegs 18 where the trap pegs are substantially evenly divided into sets and the number of trap sets match the number of player tokens 13 in the game set. Each defensive trap set has a unique color to the trap pegs of the set wherein the unique color of each trap peg set corresponds to the color of a player token 13 so that defensive trap pegs can be uniquely associated by color with player tokens and players during the game.

The game also comprises a plurality of black trap pegs 11, sharing the same size and shape as that of defensive trap pegs but identified by their black color (while defensive trap pegs are the colors of the player tokens). These black trap pegs are distributed on certain squares 11 on the track 24 according to a roll of the dice by one player at the beginning of the game, the matter discussed in further detail below.

The game includes a plurality of blue chips representing monetary currency for use by the players during the game, for example for purchasing traps or challenges during the game play. A player may accumulate blue chips when the player wins a turn. Winning a turn is discussed further below. The game further includes a plurality of white chips 36 having dots 38 affixed thereon delineating the maximum number of dice rolls a player has to extricate his token 13 out of a trapped square. The game additionally has a plurality of advancement cards 40, the advancement cards forming a deck of cards. Each advancement card has one or more dots 42 wherein the number of dots 42 on the card identifies the number of squares 11 a player is to advance their token on the track when the advance card is drawn.

The game includes a plurality of color challenge cards 46. For game play the game includes a set of conventional dice 44 having dots affixed on each side indicating numbers one through 6. The game includes a book 70 or pamphlet of rules for playing the game.

Other items useful to playing the game include a calculator for officiating a challenge, a score pad 16, and one or more pencils or pens for marking the score pad. These items may be provided with the game or alternately provided separately by the players playing the game.

In one preferred embodiment the game comprises twenty four defensive trap pegs 18, twenty color challenge cards 46 in a deck of color change cards 47 and six player tokens 13. The defensive trap pegs 18 and player tokens 13 are provided in the following colors: red, white, silver, blue, orange, and purple. Additionally in a preferred embodiment sixteen black trap pegs are provided.

The rules and method for playing the game of the present inventive disclosures are outlined below for one embodiment of the game. The certain rules may be modified in other embodiments without deviating from the intent of this inventive disclosure.

Pre-game:

One player, chosen through any means, must roll both dice 44. With the dice roll the player must come up with at least a combined seven (additive numbers from both dice). Whatever number (seven or more) that shows on the dice is the increment at which black traps must be placed along the track on the board. The player placing the traps begins by counting from the start space and begins distributing the black traps at the increment number rolled. Any space which holds a black trap is considered "dead" and no other colored trap can be placed on that space for the duration of the game. Next, each player will receive a number of defensive trap pegs 18 to place on the board during the game play. With four or less players, each player will receive three defensive traps of each of his opponent's token colors to distribute. Defensive traps may be placed on any square with the exception of "dead" squares (see above).

Game Begins:

Play begins by each player rolling a single die. This is the "off-the-block" phase of the race. Usually, someone will grab a pretty good lead right off the bat with this initial role. Each player must roll a one or a six in order to get off the block. It may take several rolls to accomplish this feat. If a player rolls and does not come up with a one or a six, then the player must pass the dice and wait for them to come around again.

Initial Move:

Once a player is off the start square, the player must win a turn. A turn, once the player wins it, can be used in one of the following ways:

A player can pick an advancement card.

A player can pick a blue chip.

A player may set a defensive trap.

A player may call a challenge.

A player may be called out on a "color" challenge.

These are described in the paragraphs that follow.

Advancement Card—

Once a player wins a turn, he may immediately choose an advancement card 40. FIG. 4 depicts two sample advancement cards 40 of a game deck of advancement cards 73. The number of dots on each card 42 tells the player how many squares the player is to advance their token 13. If a player lands on a square 11 without a black or a defensive trap having a color matching the player's token, then the player is safe until the next turn. If, however, a player lands on a trapped space—that is to say that the square has a defensive trap matching the player's token color or the square has a black trap on it, then the player is not safe and must, with the next turn, begin attempting to escape the trap.

Picking a Blue Chip—

A blue chip 36 is currency which can be accumulated by players during game play when the player wins a turn. Blue chips can be used to purchase one of the following.

1) Traps,

2) Challenges.

Winning a turn gives a player the option to perform an action or pick up a blue chip. A player is allowed to pick up only one blue chip per turn. It takes three blue chips to buy a defensive trap (at which point the purchasing player can place the trap on any square that is not a dead square). It takes five blue chips to issue a challenge (challenges will be explained in detail below).

Setting a Defensive Trap—

Once a player garners three blue chips, the player may pick any color defensive trap 18 and place it on any square which is not a dead square. Defensive traps are color coded to identify the player token and player against which they are effectively used to trap the player.

Calling (Issuing) a Challenge—

Once a player garners five blue chips, the player may issue a challenge to any player. The player must roll both dice 44. The number rolled is the target number. Once the target number is established, the challenge begins. Each player, beginning with the challenged player, rolls the die in turn until the target number comes up. Whoever rolls the target number first wins the challenge. The winner of the challenge then rolls one die. The number rolled is to be multiplied by two. The resulting number (no more than ten) is the number of spaces the loser or losers of the challenge must retreat his/her player piece or token 13.

Color Challenge—

If a player lands on a square with a black trap on it (a dead square), the player is in danger-for the duration of the turn of being called on a color challenge. Any player (other than the person who landed on the dead square) can call out a color challenge. Whoever calls it out first wins the opportunity to implement the color challenge. Both players involved must then decide on who will officiate the challenge. The officiating player must have a calculator and a score pad handy. Then, the initiator of the challenge must roll one die and call out the number rolled to the official. The official must then draw a color challenge card 46 and locate each player's color 50 and corresponding number 52 (he cannot show it to anyone at this point). Next, the officiating player must calculate what the number rolled times each players' color number is. The officiating player will write down on the pad two different numbers which are kept hidden from view, one number for the challenged player and one for the challenger player. Once this is decided, the official can turn over the card and yell 'go!' On the color challenge card is each player's color, along with a corresponding number for each color. Each player involved in the challenge must know his opponent's color so that he/she can determine the corresponding number from the color challenge card 46. The player who calls out the correct answer first wins the challenge. It's important to note that only the answer can be called out to win the challenge. A player may not talk their way out loud to the answer (for example, a player may not say "six times fourteen is eighty-four". Instead, the player must only say "eighty-four!"). If a player talks their way through the problem out loud, then this offending player automatically loses the challenge. The first person (challenged player or challenger player) to call out the correct answer wins the challenge. The officiating player must then announce the winner and prove the answer is correct by showing the calculator produced numbers the officiating player wrote on the score pad. The loser of the challenge must then move his/her piece backwards on the track by a number of squares corresponding to the number rolled on two dice (then rolled by the winner of the challenge). The used color challenge card is then placed on the bottom of the deck of color challenge cards.

Advancing Along the Game Play Track—

If a player wins a turn by rolling a one or six with one die during their turn and decides to try and advance their piece along the track, the player must pick an advancement card 40. The player will pick one card which will have any number from zero to four written in dots 42, on the advancement card 40. The number of dots on the card indicates how many squares the player may advance.

Landing on a Trapped Square—

If a player lands on a square where a defensive trap matching the player's token color is located, then the player is trapped. The player will note the number of dots 20 on the square 11 on the track. This number of dots 20 indicates what the player must roll with both dice in order to free him/herself from the trap. Once trapped, the player must roll one die to determine the method to be used for achieving freedom from the trap. If the trapped player rolls a one or a six, the player may later roll a multiple of the number indicated on the square in order to achieve freedom (for instance, if there are two dots on the square, then the trapped player may achieve freedom by rolling a 2, 4, 6, 8, 10, or 12. This method is generally the easiest to achieve freedom). If the player's one die roll instead resulted in a 2, 3, 4, or 5 then the player must pick up a white chip. White chips 36 are provided with dots 38 to indicate the maximum number of rolls a player must make in order to achieve freedom, which is to say that if a player does not achieve freedom from the trap after the maximum number of rolls (also related to turns), then the trapped player is automatically freed. For example, if a player picks a white chip with 7 dots on it, the player has a maximum of 7 turns trapped on the square. If the player rolls the number indicated on the trap square at any time during that seven turns, the player achieves freedom and can advance his/her piece the next time the player wins a turn.

Whenever a player is trapped and picks a white chip 36, the player to his/her immediate left is required to keep a running tab on the number of rolls performed by the trapped player to escape the trap. He/she must inform the trapped player that trapped player is free after the last roll (if the trapped player has failed to roll the number indicated on the trapped square). If one complete turn has been completed after the trapped player wins freedom and the player to the immediate left of the trapped player has not informed the trapped player that he/she is free, then the player to the immediate left of the trapped player must move his/her piece back one square as a penalty.

Rolling Doubles—

Anytime a player rolls two dice and achieves the same number on each die (a double), one of three things can occur.

1) The player may place a defensive trap (of any color on any non-dead square),
2) The player may pick an advancement card (if the double rolled is greater than seven) and roll again,
3) The player may roll again (if the doubles rolled add up to less than seven) and try to win a turn.

The discussed construction, illustrations and sequence of operation is for one embodiment of the invention, but is in no way limiting to other embodiments. The operating modes may be changed and enhanced without deviating from the intention of this inventive disclosure.

In the preceding detailed description, reference has been made to the accompanying drawings that form a part hereof, and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that logical, material, and mechanical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A race game where competitors apply defensive strategies while racing to be the first to the finish square, the game comprising:

a plurality of player tokens, each player receiving a token, each token used to represent the movement of a player along a game play track, each token having a unique color for easy identification by the players, wherein black is not one of the token colors;

a plurality of defensive trap pegs, the trap pegs substantially evenly divided into sets, the number of trap sets matching the number of player tokens, each trap set having a unique color, the unique color of each trap set corresponding to a player token;

a plurality of black trap pegs;

a plurality of blue chips representing monetary currency for use by the players during the game, wherein blue chips can be used to purchase traps or challenges;

a plurality of white chips having dots afixed thereon delineating the maximum number of dice rolls a player has to get out of a trap;

a plurality of advancement cards, the cards forming a deck of cards, each advancement card having one or more dots wherein the number of dots identifies the number of squares a player is to advance their token on the track;

a plurality of color challenge cards, the cards forming a deck of cards;

two dice; and a game board comprising:

the game play track secured to the board, the track having a plurality of player squares, each player square having a plurality of peg holes for removably securing trap pegs to the square, the squares linked to form the track, the track having a start square and a finish square, each player square having one color selected from the set of unique colors of the player tokens such that the game play track is representative of the player token colors, wherein each square except the start and finish have one or more dots affixed to the square; and a plurality of trap holding squares secured to the board, one trap holding square for each player token;

wherein one player starts the game by rolling both dice and placing black trap pegs on the track at rolled dice increments of seven or more, where squares having black traps are dead squares;

wherein players receive a plurality of defensive trap pegs to place on squares about the track, the peg color matching color of player's opponent tokens, where colored trap pegs may be placed on any square except a dead square;

wherein each player must start the game by rolling a one or six with a single die to get off the start square;

wherein an object of the game is for individual players to reach the finish square first; and wherein individual players may hinder the progress of other players track by placement of trap pegs on squares, calling challenges, calling players out on color challenges.

2. The race game of claim 1, wherein:

the set of player tokens consists of six colored player tokens, one each of red, white, blue, yellow, orange and green;

wherein each set of defensive trap pieces consists of 24 trap pieces; and wherein the plurality of color challenge cards consists of twenty color challenge cards;

wherein the player is off the start square, the play can advance on the track by picking an advancement card, by picking up a blue chip, by setting a defensive trap peg on the track, by calling a challenge, by calling a player out on a color challenge;

wherein a token landing on a square having one of black trap peg, defensive peg matching player's token color identifies the token as not safe such that player's next turn must begin with player attempting to advance their token to escape the trap;

wherein a player wins turn by rolling one die resulting in a one or a six, wherein winning the turn provides a player the option to select one blue chip or select one advancement card;

wherein the dots on the advancement card indicate the number of squares the player may advance their token on the track;

wherein the player may purchase defensive trap of any color using blue chips and place the trap on any square of the track that is not a dead square;

wherein player's token landing on a square having a defensive trap peg matching the color of the player's token is trapped, wherein the player with the trapped token rolls one die to determine method of achieving freedom from the trap, wherein the number of dots in the trapped token's square is used to determine conditions for the trapped token leaving the trap;

wherein the player having a defined number of blue chips may issue a challenge to any player, wherein the player issuing the challenge rolls both dice to obtain a target number; wherein the challenged player, other players other than lastly the challenge issuing player each roll two dice in turns until the target number results from the dice roll, then the player with dice roll matching the target number wins the challenge, the challenge winner then rolling one die, multiplying the die roll number by two to obtain a retreat number, wherein the retreat number is limited to no more than ten, wherein players other than the challenge issuing player and winner of the challenge must then retreat their token on the track by the retreat number of squares;

wherein player landing on a dead square is in danger of being called on a color challenge by another player, wherein the player landing on the dead square and the color challenging player selects player to officiate the color challenge, wherein the officiating player draws a color challenge card and interacts with the player landing on the dead square and the color challenging player to determine a winner of the color challenge, wherein the winner of the color challenge rolls two dice to determine the number of squares loser of the color challenge must retreat their token; and wherein player rolls two dice to obtain a rolled number, the player performs one of:

placing a defensive trap peg of any color on a non-dead square, if the rolled number is greater than six then selecting one advancement card and rolling again, if the rolled number is less than seven then rolling again to try to win a turn.

3. A method of playing a race game where competitors apply defensive strategies while racing to be the first to reach the finish square, the method comprising:

providing a game board comprising:

a game play track affixed to a game board, the track having a plurality of player squares, the squares linked to form the track, the track having a start square and a finish square, each player square having one color selected from the set of unique colors of the player tokens such that the game play track is representative of player token colors, wherein each square except the start and finish have at least two and no more than 6 dots affixed to the square;

providing the following for game play:

a plurality of player tokens, each player receiving a token, each token used to represent the movement of a player along a game play track, each token having a unique color for easy identification by the players, wherein black is not one of the token colors;

a plurality of defensive trap pegs, the trap pegs substantially evenly divided into sets, the number of trap sets matching the number of player tokens, each trap set having a unique color, the unique color of each trap set corresponding to a player token;

a plurality of black trap pegs;

a plurality of blue chips representing monetary currency for use by the players during the game, wherein blue chips can be used to purchase traps or challenges;

a plurality of white chips having dots affixed thereon delineating the maximum number of dice rolls a player has to get out of a trap;

a plurality of advancement cards, the cards forming a deck of cards, each advancement card having one or more dots wherein the number of dots identifies the number of squares a player is to advance their token on the track;

a plurality of color challenge cards, the cards forming a deck of cards, each card having a table of token colors and corresponding color numbers; and two dice;

selecting a token player piece for use in moving about the game track during game play, each player selecting one uniquely colored token;

placing player tokens in the start square;

distributing defensive trap pegs to each player, wherein each player receives defensive trap pegs in colors corresponding to opponent player's token colors;

choosing a player to roll both dice until the dice roll results in a number of seven or greater, then starting at the start square and counting, placing black trap pegs in squares at increment number rolled in the dice roll, wherein any square having a black trap peg is considered dead and no defensive trap pegs may be placed in the dead square during the game;

rolling a single die by all players in turn, wherein a player must roll a one or six in order to move off the start square, wherein if a player does not roll a one or six the player must pass the dice to a next player and wait for dice to come around again;

if the player rolled a one or six and the player's token landed on the dead square in player's previous turn, then noting the number of dots on the dead square having the player's token as the base trap escape number;

taking a white chip; and noting the number of dots on the white chip as the maximum number of trapped turns;

if the player's token is on a dead square and the player rolled one of: one, six at the roll a single die by all players step, then rolling two dice to obtain a trial escape number;

if the trial escape number is an integer multiple of the base trap escape number, then permitting the player to leave the dead square on next turn;

if the number of turns the player's token has been trapped is greater than the maximum number of trapped turns, then permitting the player to leave the dead square on next turn; and continuing at the passing the dice step;

if the player rolled one or six, then the player has won a turn, wherein winning the turn enables the player to choose one of:

picking one advancement card, taking one blue chip, wherein blue chips are accumulated as currency and are used to buy defensive trap pegs to set on any square, or to purchase the right to issue a challenge;

placing one defensive trap peg on a square on the track;

challenging another player, wherein the right to call the challenge is purchased with blue chips; and calling another player out on a color challenge, wherein the token of the player called in the color challenge must be on a dead square;

if the player winning the turn picked advancement card, then advancing token of turn winning player on the game track by a square count determined by the number of dots on the advancement card and continuing at the passing the dice step; and if the player's token reaches the finish square, then continuing at the step of declaring winning player;

passing the dice to the next player;

continuing at the step of rolling a single die by all players in turn; and declaring winning player as the player whose token reached the finish square.

4. The method of claim 3, wherein before the step of passing the dice to the next player the method further comprises:

if the player winning the turn challenges another player, then:

rolling both dice to obtain a target challenge number, wherein the dice are rolled in turn by each player beginning with the challenged player;

if the player rolling the dice rolls the target challenge number, then the player rolling the dice won the challenge and continues at the step of rolling one die by the player winning the challenge;

passing the dice to the next player, excluding the player issuing the challenge;

continuing at the step of rolling both dice to obtain a target challenge number;

rolling one die by the player winning the challenge to obtain a retreat number;

doubling the retreat number;

limiting the retreat number to no greater than ten;

retreating tokens on players not winning the challenge by the retreat number of squares on the track; and continuing at the passing the dice step;

if the player winning the turn calls color challenge on another player, then:

deciding upon player who will officiate the color challenge;

rolling one die by the color challenging player and providing the number to the officiating player;

drawing one color challenge card by the officiating player;

multiplying the number rolled by the color challenging player times the color number on the color challenge card corresponding to challenged players token and recording as a first number, officiating player keeping the number hidden;

multiplying the number rolled by the color challenged player times the color number on the color challenge card corresponding to challenged players token and recording as a second number, officiating player keeping the number hidden;

deciding the winner of the color challenge, wherein the winner is decided by the first occurrence of:

calling out the second number by the color challenging player; and calling out the first number by the color challenged player, wherein the loser of the color challenge rolls two dice and retreats token on the game track by the number of squares corresponding to the number rolled.

* * * * *